US012402716B1

(12) United States Patent
Sigrist

(10) Patent No.: US 12,402,716 B1
(45) Date of Patent: Sep. 2, 2025

(54) GROCERY BAG HOLDER AND METHOD OF USE

(71) Applicant: Nick Sigrist, Havre, MT (US)

(72) Inventor: Nick Sigrist, Havre, MT (US)

( * ) Notice: Subject to any disclaimer, the term of this patent is extended or adjusted under 35 U.S.C. 154(b) by 0 days.

(21) Appl. No.: 19/093,265

(22) Filed: Mar. 28, 2025

(51) Int. Cl.
*A45F 5/10* (2006.01)

(52) U.S. Cl.
CPC ..... *A45F 5/102* (2013.01)

(58) Field of Classification Search
CPC ..... A45F 5/102; A45F 5/1026; A45F 2005/1033; A45F 2005/1073; A45F 2005/1006; A45C 3/04
USPC ..... 294/159, 137, 143
See application file for complete search history.

(56) References Cited

U.S. PATENT DOCUMENTS 4,657,295 A * 4/1987 Holem ..... A45F 5/00 294/169
5,129,612 A * 7/1992 Beaupre ..... B60R 7/02 224/539
5,234,116 A * 8/1993 Kristinsson ..... B60R 7/02 224/925
5,836,634 A * 11/1998 Finkelman ..... A45F 5/1026 D9/434
D489,618 S * 5/2004 Startek ..... D9/434
9,539,851 B1 * 1/2017 Tanda ..... B44D 3/14
10,702,050 B1 * 7/2020 Hames ..... A45F 5/1026
2004/0232304 A1 * 11/2004 Wakura ..... G09F 15/0062 248/456
2007/0296233 A1 * 12/2007 Eichenbaum ..... A45F 5/1026 294/158
2012/0280524 A1 * 11/2012 Izzo ..... A45F 5/10 294/137
2015/0035306 A1 * 2/2015 Ewing ..... A45F 5/1026 294/159
2018/0206621 A1 * 7/2018 Harness ..... A45F 3/15

* cited by examiner

*Primary Examiner* — Paul T Chin
(74) *Attorney, Agent, or Firm* — Nathaniel A. Wickliffe

(57) ABSTRACT

A grocery bag holder can maintain grocery bags in an upright orientation while the bags are being transported in a moving vehicle. The grocery bag holder can transition from a closed conformation to an open conformation. In the open conformation, the grocery bag holder can be prevented from opening beyond a predetermined maximum opening angle. In the open conformation, the grocery bag holder can be prevented from closing beyond a predetermined angle that can be with 5-10 degrees of the maximum opening angle.

16 Claims, 10 Drawing Sheets

GROCERY BAG HOLDER AND METHOD OF USE

FIELD OF THE INVENTION

This application relates generally to a grocery bag organizer, and more particularly, to a collapsible grocery bag holder and method of use that can allow a user to keep grocery bags upright in a moving vehicle and transport them easily from the vehicle to the home.

BACKGROUND OF THE INVENTION

Grocery shopping is an essential part of our day-to-day lives for most people. In most cases, groceries are packaged at the checkout in either flimsy plastic disposable bags, or in reusable bags that are often made of canvas or other fabrics. Both of these bags, herein referred to as grocery bags, tend to have handles at the top and a flexible nature with a lack of rigidity. When these flexible, even floppy, bags are loaded into a vehicle, they are often prone to tipping and spilling their contents as the vehicle moves and shifts from side to side. This often results in a significant portion of the groceries that started in the bag ending up scattered around the interior of the vehicle.

After arriving back home from the store and repacking all of the groceries back into the grocery bags again, it can be inconvenient to gather all of the grocery bag handles together and carry all of them into the home by hand. In the event of a large number of bags, not only is it inconvenient to gather all of the handles together while keeping all of the bags upright, but in some cases the bags hanging together from the hands of the user can be bulky and cumbersome as they are all hanging together from the same point. Furthermore, the weight of the thin handles of many bags together can be uncomfortable to the hands of the user as the user carries the heavy bags from the car to the kitchen.

It would be desirable to have a device and method that allows a user to keep floppy grocery bags upright in a moving vehicle. It would be further desirable to have a device and method that allows a user to quickly and easily transport the floppy grocery bags filled with groceries into the home without needing to first repack the groceries, then gather the handles, and then carry the heavy bags hanging and swinging together with the thin plastic handles cutting into the user's fingers.

SUMMARY OF THE INVENTION

This disclosure overcomes disadvantages of the prior art by providing a device and method for keeping floppy grocery bags upright in a moving vehicle by providing a rigid platform that grocery bags can be attached to. Furthermore, the rigid platform can be picked up by the user with all of the grocery bags attached, thereby allowing the user to quickly pick up all of the bags, with the groceries still inside of them, and transport the entire group of bags into the home quickly and easily.

In an embodiment, a grocery bag holder can have a first support, and the first support can have an upper handle region that can include a handle. The first support can have a first lower portion with a base area. The first support can have a hinge region between the upper handle region and the first lower portion, wherein the upper handle region extends up above the hinge region that has at least one hinge. A second support can have a second lower portion with a second base area, and an upper hinge region. The upper hinge region can be hingedly connected to the hinge region of the first support by the at least one hinge. The grocery bag holder can have a plurality of bag suspenders adapted to hold grocery bag handles.

In various embodiments, grocery bag holder can include a support strap connected to the first support and the second support, the support strap preventing the first lower portion from pivoting away from the second lower portion beyond a predetermined maximum angle. The grocery bag holder can include a selectively engageable prop adapted to engage between the first lower portion and the second lower portion, the selectively engageable prop selectively preventing the first lower portion and the second lower portion from pivoting towards each other beyond a predetermined angle. The grocery bag holder can include a storage pocket, the storage pocket connected to the first support and the second support, the storage pocket acting as a pivot limiter to limit the maximum angle of the first lower portion relative to the second lower portion. The grocery bag holder can include a selectively engageable catch adapted to engage between the second support and the upper handle region of the first support, the selectively engageable catch selectively preventing the second support and the upper handle region of the first support from pivoting away from each other beyond a predetermined angle. The upper handle region of the first support can be bent at an angle relative to the first lower portion, so that the upper handle region leans downwards and towards the second support. The grocery bag holder can include a plurality of LED lights located on the first support and/or second support. The grocery bag holder can include further circuitry that enables the LEDs to flash in a manner adapted to warn drivers of possible danger. The first base area and the second base area can include non-skid feet adapted to prevent the grocery bag holder from slipping in a moving vehicle.

In an embodiment, a method of transporting groceries can include transitioning a grocery bag holder to an open conformation, the grocery bag holder having a first support, and the first support can have an upper handle region that can include a handle. The first support can have a first lower portion with a base area. The first support can have a hinge region between the upper handle region and the first lower portion, wherein the upper handle region extends up above the hinge region that has at least one hinge. A second support can have a second lower portion with a second base area, and an upper hinge region. The upper hinge region can be hingedly connected to the hinge region of the first support by the at least one hinge. The grocery bag holder can have a plurality of bag suspenders adapted to hold grocery bag handles. The method can include setting the grocery bag holder in the open conformation within a storage space of a vehicle, hanging the handles of grocery bags on the plurality of hooks, and driving the vehicle with the groceries remaining within the grocery bags.

In various embodiments, after driving the vehicle home with the groceries remaining within the grocery bags, the method can include lifting the grocery bag holder out of the vehicle with grocery bags hanging from the hooks, and carrying the grocery bag holder into a residence. The method can include setting the grocery bag holder on a counter or table in a residence with the grocery bags hanging from the hooks and the groceries within the grocery bags, and emptying the groceries out of the grocery bags and into the appropriate food storage areas within the home. The method can include engaging a selectively engageable catch between the second support and the upper handle region of the first support, the selectively engageable catch preventing the second support and the upper handle region of the first support from pivoting away from each other beyond a predetermined angle. After driving the vehicle home with the groceries remaining within the grocery bags, the method can include disengaging the selectively engageably catch between the second support and the upper handle region, thereby allowing the grocery bag holder to transition to a closed conformation, and lifting the grocery bag holder out of the vehicle with grocery bags hanging from the hooks, and carrying the grocery bag holder into a residence. The method can include engaging a selectively engageable prop between the first lower portion and the second lower portion, the selectively engageable prop selectively preventing the first lower portion and the second lower portion from pivoting towards each other beyond a predetermined angle. After driving the vehicle home with the groceries remaining within the grocery bags, the method can include disengaging the selectively engageable prop between the second support and the upper handle region, thereby allowing the grocery bag holder to transition to a closed conformation, and lifting the grocery bag holder out of the vehicle with grocery bags hanging from the bag suspenders, and carrying the grocery bag holder into a residence.

BRIEF DESCRIPTION OF THE DRAWINGS

The invention description below refers to the accompanying drawings, of which.

DETAILED DESCRIPTION

There are a great many possible implementations of the invention, too many to describe herein. Some possible implementations are described below. In the following description, for purposes of explanation, numerous specific details are set forth in order to provide a thorough understanding thereof. It should be clear, however, that the innovation can be practiced without various specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, any particular embodiment need not have all the aspects or advantages described herein. Thus, in various embodiments, any of the features described herein from different embodiments may be combined. It cannot be emphasized too strongly, however, that these are descriptions of implementations of the invention, and not descriptions of the invention, which is not limited to the detailed implementations described in this section but is described in broader terms in the claims. Further, the terms and phrases used herein are not intended to be limiting but rather to provide an understandable description of the invention.

Figure 1:
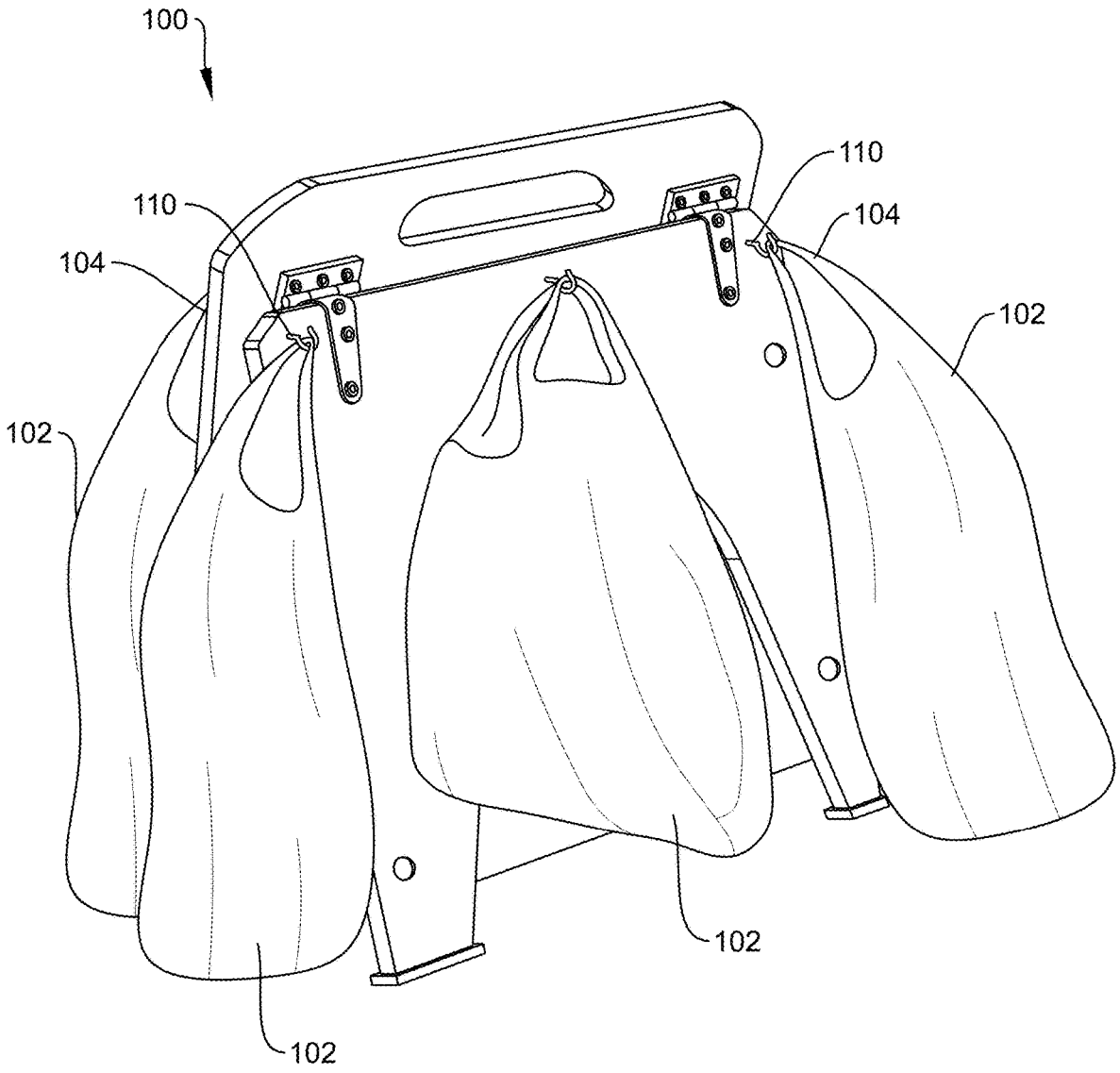
FIG. 1 is a perspective view of a grocery bag holder holding grocery bags, according to an illustrative embodiment.

FIG. 1 is a perspective view of a grocery bag holder holding grocery bags, according to an illustrative embodiment. A grocery bag holder 100 can support a multitude of grocery bags 102 that have handles 104. Grocery bags 102 can be made from plastic, canvas, various fabrics, paper, or other materials. Grocery bag holder 100 can support various grocery bags 102, keeping each grocery bag in an upright position. Grocery bag holder 100 can have a plurality of bag suspenders 110, and the handles 104 of the grocery bags 102 can hang from the bag suspenders 110. In various embodiments, the bag suspenders 110 can be hooks, knobs, or other shapes that the grocery bags can hang from. In various embodiments, bag suspenders 110 can be hook-and-loop tape that can be wrapped through the handles 104 to secure the handles to the grocery bag holder 100. As used herein, terms such as bag suspenders, hooks, and knobs can all be used to describe a physical component of the grocery bag holder that can hold the handles of a grocery bag in an upright position.

Grocery bag holder 100 can have a plurality of bag suspenders 110 that can be hooks, and the handles 104 of the grocery bags 102 can hang from the hooks 110. The grocery bag holder 100 can hold the handles 104 upwards, so that the grocery bag is held with the mouth also facing upwards. By holding the handles up, and therefor holding the mouth of the grocery bag upward, the groceries cannot spill out of the mouth of the grocery bag.

Grocery bag holder 102 can be made from wood, fiberglass, metal, plastic, PVC, or various other materials. Although the grocery bag holder 102 is shown as having mostly solid and planar supports, it should be clear that variations are possible, including a wireframe design, or others.

Figure 2:
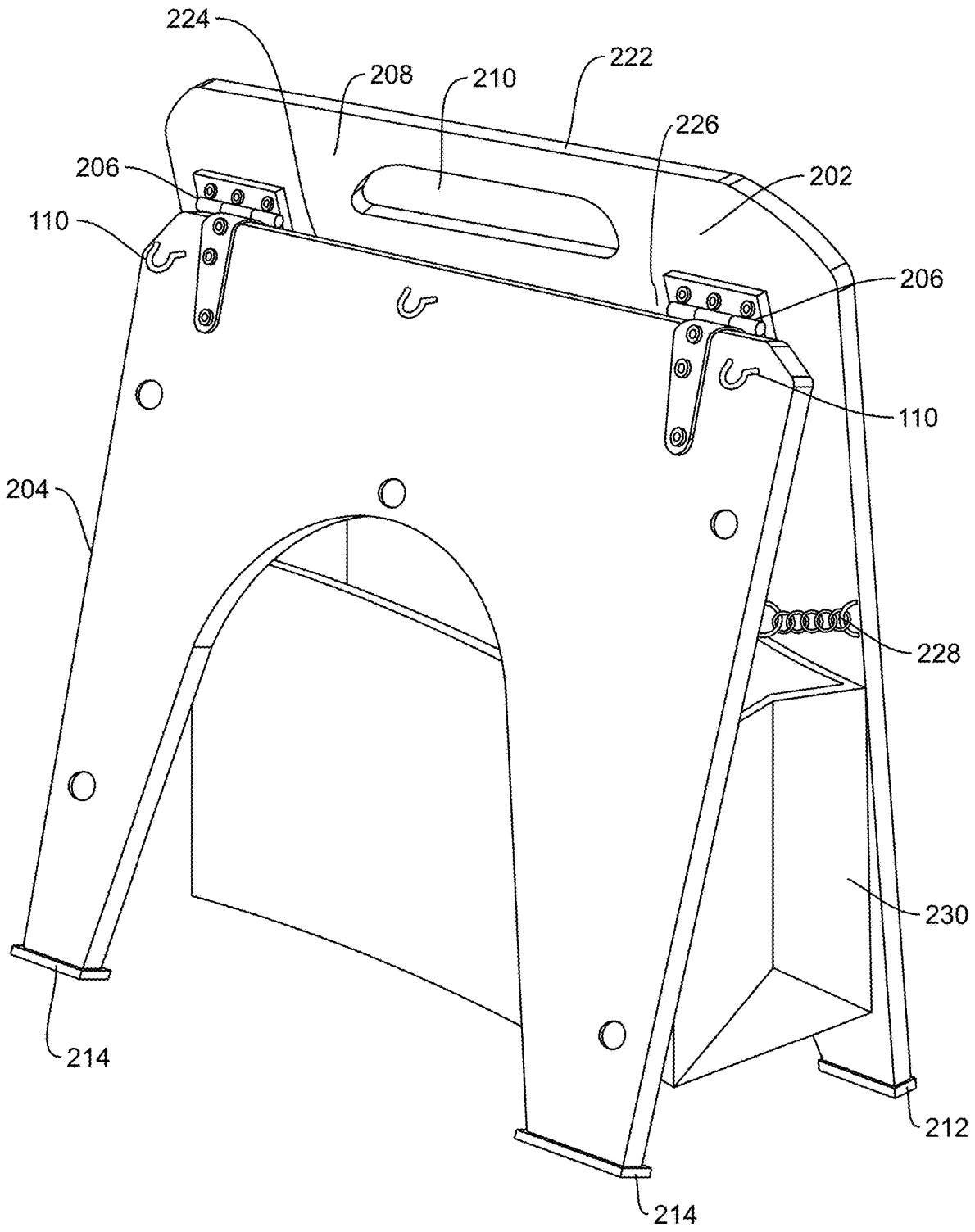
FIG. 2 is a perspective view of a grocery bag holder with a storage pocket in the interior area of the grocery bag holder, according to an illustrative embodiment.

FIG. 2 is a perspective view of a grocery bag holder with a storage pocket in the interior area of the grocery bag holder, according to an illustrative embodiment. A grocery bag holder 100 can include a first support 202 and a second support 204. First support 202 and second support 204 can be pivotably joined by one or more hinges 206. The one or more hinges 206 can be one or more of a butt hinge, a ball bearing hinge, a barrel hinge, an overlay hinge, a piano hinge, a strap hinge, or any other of a number of other types of hinges.

First support 202 and second support 204 can be configured to pivot between an open configuration, as shown in FIG. 2, and a closed configuration. First support 202 and second support 204 can have base areas 212, 214 that are configured to set flat a floor of a trunk, bed of a truck, kitchen counter, or other surface. In various embodiments, base areas 212 and 214 can have distinct areas that act as feet. In the open configuration, as shown in FIG. 2, the first support 202 and second support 204 can be pivoted away from each other at the hinge 206, so that the base areas 212 and 214 are distant from each other. In the open configuration, the grocery bag holder can stand upright with the base areas 212 and 214 distant from each other and sitting on a supporting surface such as the floor of a trunk.

The topmost portion 224 of second support 204 can meet hinge 206, so that second support 204 pivots around the hinge 206 at the topmost portion 224 of second support 204. The first support 202 has an upper handle region 208 that extends upward above the hinge(s) 206. The upper handle region 208 can extend approximately 2 inches or more above the hinge 206. The first support can meet hinge 206 at an upper hinge region 226 of second support 202, wherein the upper hinge region 226 is at the top of the second support, but is not at the top of the first support. That is to say, the hinge region 226, where the hinge 206 meets the first support 202, is distant from the top region 222 of the first support 202. The area between the hinge region 226 and the top region 222 is the upper handle region 208. Upper handle region 208 can have a handle 210 that can be an opening within the upper handle region 208, or can be a handle extending above the upper handle region 208. The second support 204 can pivot relative to the first support 202 at hinge 206, and with the topmost portion 224 of the second support 204 being adjacent to the hinge region 226 of the first support 202. The top region 222 of the first support 202 can be distant from the hinge area and the topmost portion 224 of the second support 204. The handle 210 is part of the first support 202, and a user can carry the grocery bag holder by holding the handle of the first support 202.

The handle extends above the hinge and above the second support. The second support 204 can be free from a handle area, and the grocery bag holder can be carried by a user who only needs to hold the single handle on the upper handle region 208 of the first support 202. Because the user only needs to hold a single handle that can be part of the first support, with the handle being above the top of the second support, the user can easily carry the grocery bag holder even when the second support is distant from the first support, in the open conformation. This single handle design allows the grocery bag holder to be carried by anyone, with any size hands, even in the open conformation.

In various embodiments, a pivot limiter such as support strap 228 can limit how far the second support member 204 can pivot relative to the first support member. If the second support member were allowed to pivot a maximum 180 degrees relative to the first support member, with the base areas 212 and 214 being 180 degrees apart from each other, the grocery bag holder 100 would not stand up in that condition, and would therefore not be able to hold the handles and mouths of the grocery bags up. Support strap 228 can be a chain, fabric, string, rope, or other flexible material that can prevent the second support 204 from pivoting too far relative to the first support 202. Put another way, the support strap can prevent the base area of the second support from moving too far away from the base area of the first support. The strap 228 can maintain the first support and second support at a predetermined maximum angle relative to each other so that the grocery bag holder can stand upright and hold the handles and mouths of the grocery bags up.

In various embodiments, a grocery bag holder 100 can have an inner storage pocket 230 within the interior area of the grocery bag holder. The inner storage pocket 230 can be attached to the first support 202 and the second support 204. In embodiments with a storage pocket 230, the storage pocket 230 that is attached to the first support and second support can act as pivot limiter by preventing the second support from pivoting relative to the first support beyond a predetermined maximum angle. In various embodiments, the predetermined maximum angle can be between approximately 15 degrees and approximately 45 degrees. In various embodiments, the predetermined maximum angle can be approximately 20 degrees. In various embodiments, the predetermined maximum angle can be approximately 30 degrees. In various embodiments, the predetermined maximum angle can be approximately 40 degrees.

Figure 3:
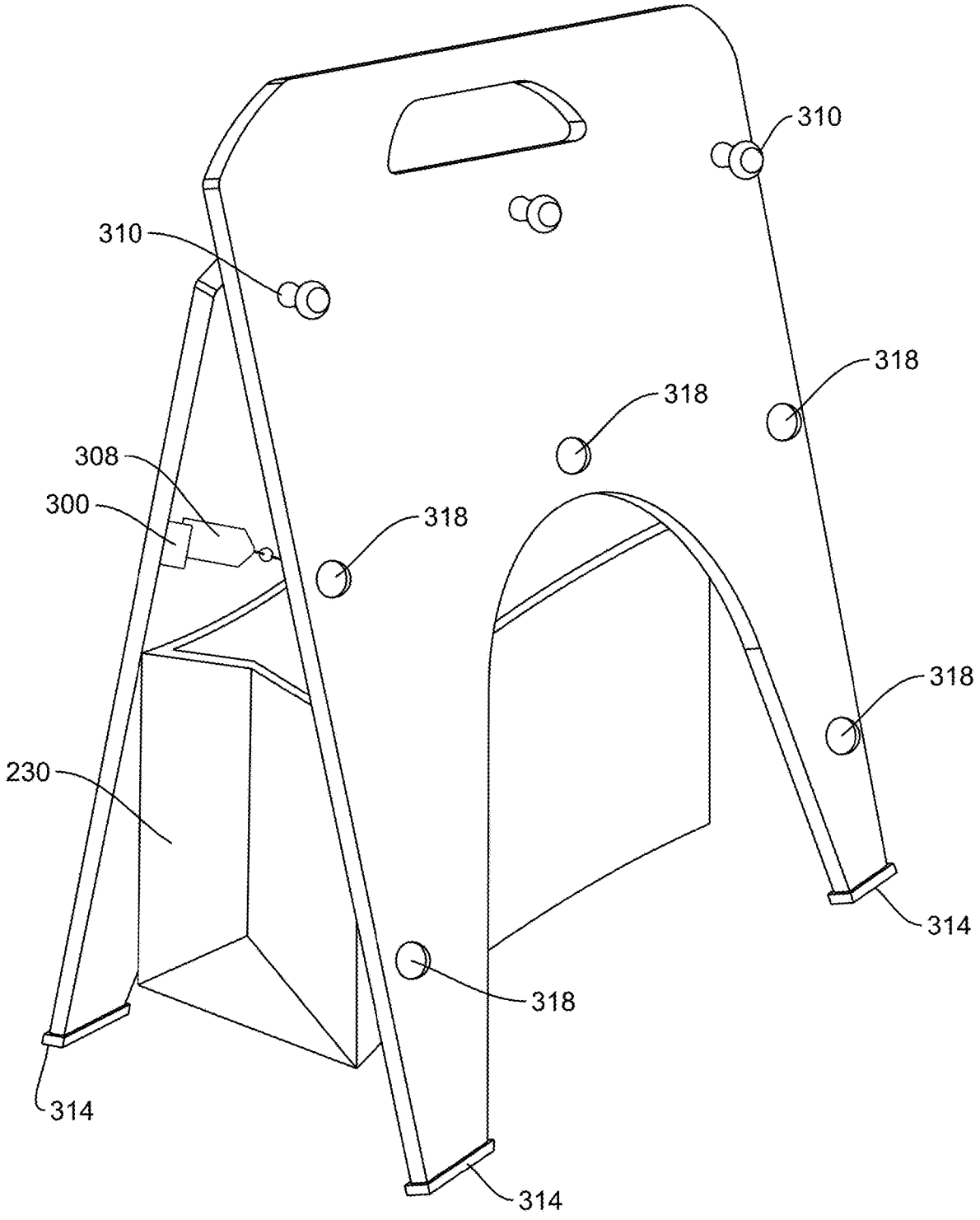
FIG. 3 is a perspective view of a grocery bag holder with a secure prop to prevent the grocery bag holder from closing while in use, according to an illustrative embodiment.

FIG. 3 is a perspective view of a grocery bag holder with a prop to prevent the grocery bag holder from closing while in use, according to an illustrative embodiment. A selectively engageable prop 300 can prevent a grocery bag holder from transitioning out of an open conformation to a closed conformation. The prop 300 can be a rigid bar or other rigid shape, and can be hingedly connected to one support. The prop 300 can be hingedly connected to either the first support 202 or the second support 204. The prop can latch into place or otherwise be held in place on the other support, which can be either the second support 204 or the first support 202. In various embodiments, the prop 300 can be a rigid bar that can be hingedly attached to one support at a proximal end, and can be held in a cradle 302 at the distal end of the bar. With the pivot limiter limiting how far the first support can pivot away from the second support, the prop can simply lay within the cradle 302 to prevent the transition to a closed conformation.

In various embodiments, the prop 300 can be a rigid bar that can be hingedly attached to one support at a proximal end, and the prop 300 can have a hook at the distal end that can be hooked into a ring on the other support. Various forms of a rigid prop are that can prevent the grocery bag holder from transitioning into a closed conformation are possible, and will be understood by one of skill in the art.

The selectively engageable prop can maintain the first support and the second support at an angle that is within 5 degrees of the maximum angle maintained by the pivot limiter. The selectively engageable prop can maintain the first support and the second support at an angle that is within 10 degrees of the maximum angle maintained by the pivot limiter.

In various embodiments, the bag suspenders 310 can be knobs or other shapes that can hold the handles of the grocery bags in an upright position. Knobs can advantageously have smooth, rounded surfaces that can help to avoid damage to car interiors that could be caused by hooks, while also providing an increased level of resistance to snagging or breaking off. It should be clear that various shapes of bag suspenders are possible, and are not intended to be limited to the specific shapes shown here.

In various embodiments, a grocery bag holder 100 can have feet 314 that can be rubber or other non-slip material that can provide traction and prevent the grocery bag holder from shifting around while the vehicle is in motion. Feet 314 can also provide cushion or other protection so that the grocery bag holder will not damage a counter or table when the grocery bag holder is full of groceries and placed on a counter, table, or other surface.

In various embodiments, a grocery bag holder 100 can have one or more LED lights 118 that are coupled to electronic circuitry (not shown). Various power sources are possible, including a battery, solar cells, and/or other power sources that will be understood by one skilled in the art. LED lights 118 can be positioned in various locations on the grocery bag holder, and can serve various functions. In various embodiments, the LED lights can be used to illuminate a work area, such as a trunk or back seat. In various embodiments, The LEDs can be used to light a user's path at night as the user is carrying the groceries from the car to the kitchen. In various embodiments, the grocery bag holder can be used to alert other drivers of a dangerous situation, such as a broken-down vehicle. LEDs on the grocery bag holder can light up in different colors including red, and can flash, strobe, or otherwise attract attention. The grocery bag holder can be opened and placed behind a stopped vehicle with the LEDs 118 flashing to warn other drivers.

Figure 4A:
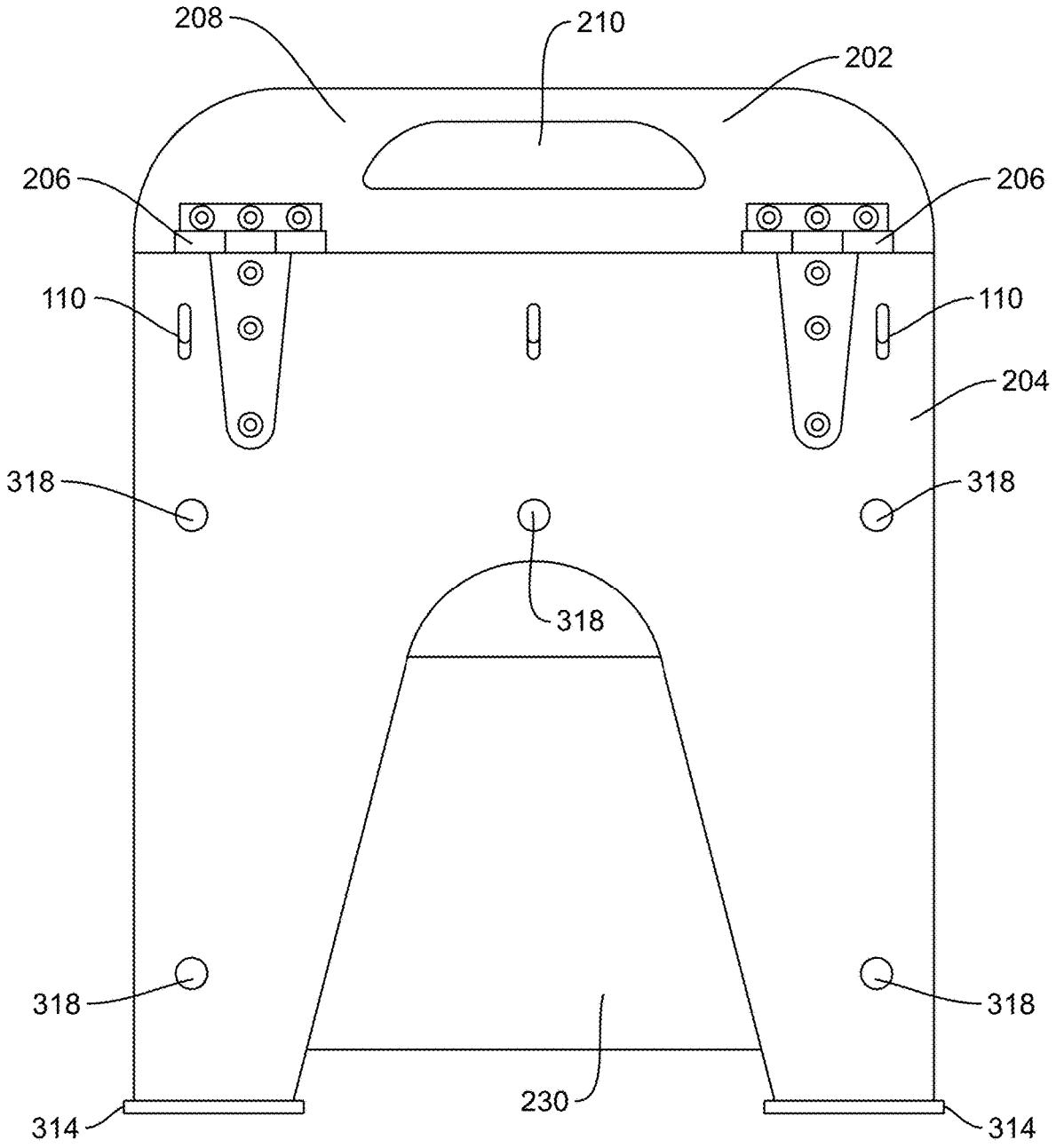
FIG. 4A is a rear view of a grocery bag holder in a closed conformation, according to an illustrative embodiment.
Figure 4B:
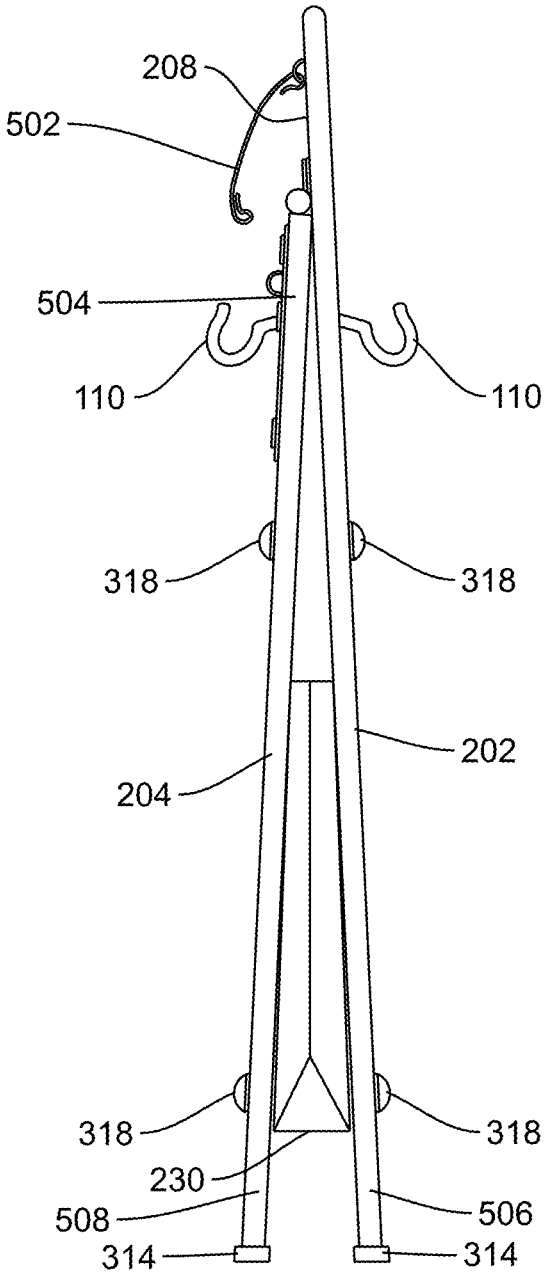
FIG. 4B is a side view of a grocery bag holder in a closed conformation, according to an illustrative embodiment.
Figure 4C:
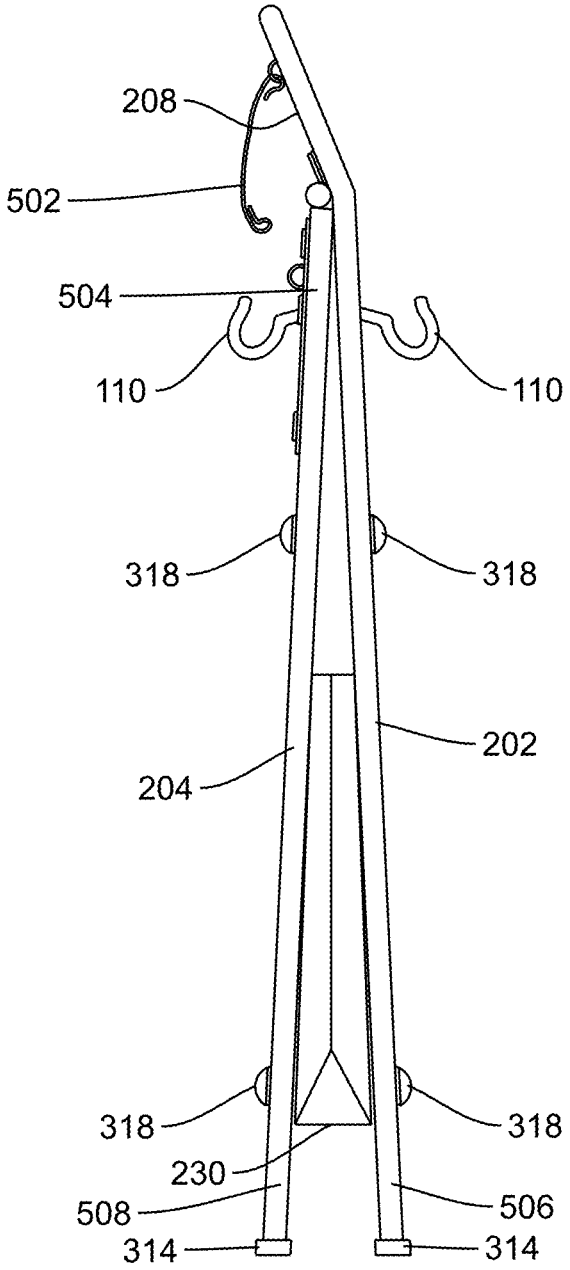
FIG. 4C is a side view of a grocery bag holder with an angled handle region and in a closed conformation, according to an illustrative embodiment.

FIG. 4A is a rear view of a grocery bag holder in a closed conformation, according to an illustrative embodiment, and FIG. 4B is a side view of a grocery bag holder in a closed conformation, according to an illustrative embodiment. In various embodiments, first support 202 and second support 204 can be planar or approximately planar, so that the grocery bag holder can fold flat in a closed conformation. FIG. 4C is a side view of a grocery bag holder with an angled handle region and in a closed conformation, according to an illustrative embodiment. In various embodiments, the upper handle region 208 can be angled towards the second support, explained more fully below.

Figure 5A:
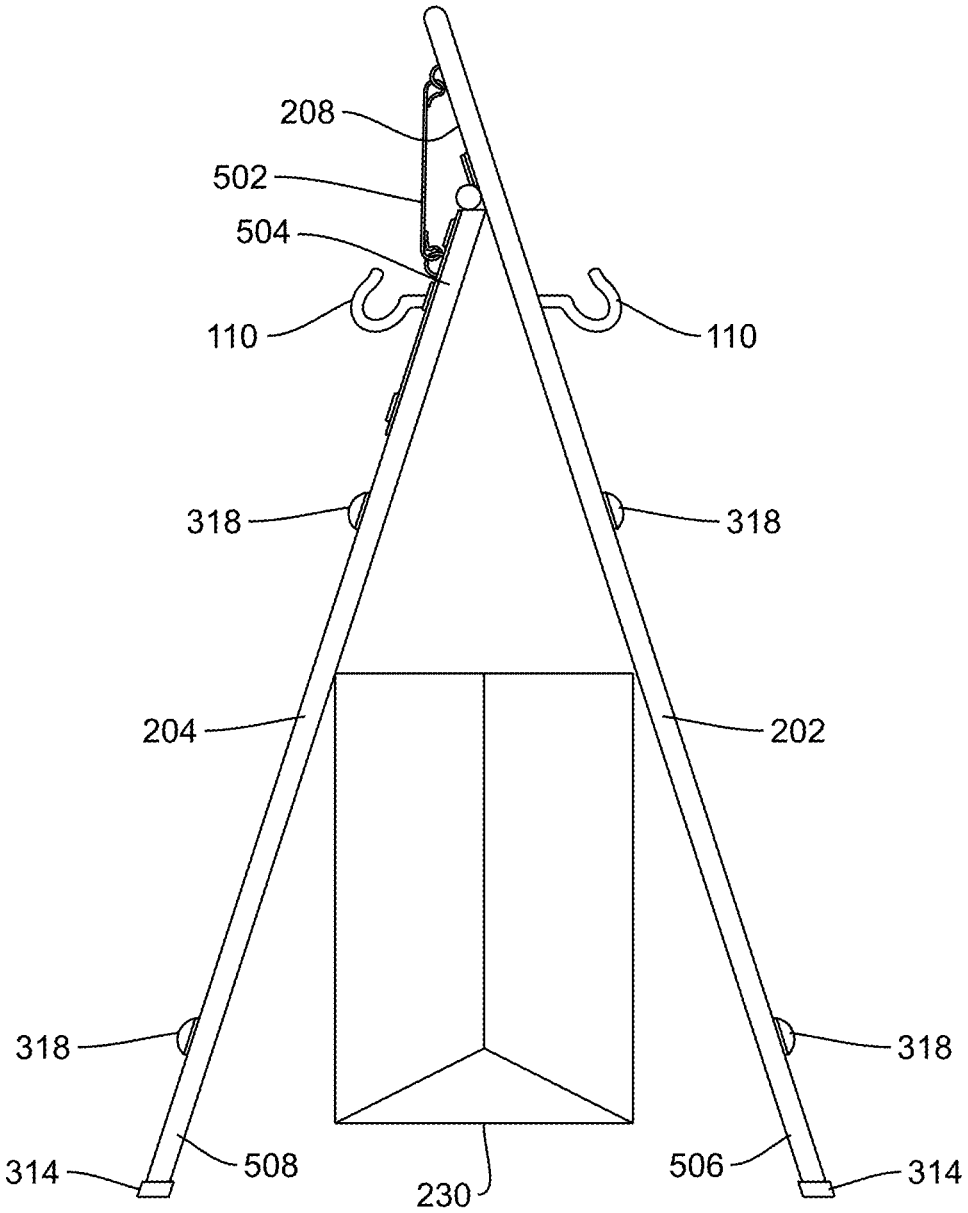
FIG. 5A is a side view of a grocery bag holder with a releasably engageable catch for keeping the grocery bag holder in an open conformation, according to an illustrative embodiment.

FIG. 5A is a side view of a grocery bag holder with a releasably engageable catch for keeping the grocery bag holder in an open conformation, according to an illustrative embodiment. The releasably engageable catch 502 can connect between the second support 204 and the upper handle region 208 of the first support 202. The releasably engageable catch 500 can prevent the second support 204 from pivoting away from the upper handle region 208, or put another way, the releasably engageable catch can prevent the lower portion 508 of the second support 204 from pivoting towards the lower portion 506 of the first support 202. In various embodiments, the releasably engageable catch can be connected between an upper portion 504 of the second support 204 and the upper handle region 208.

Figure 5B:
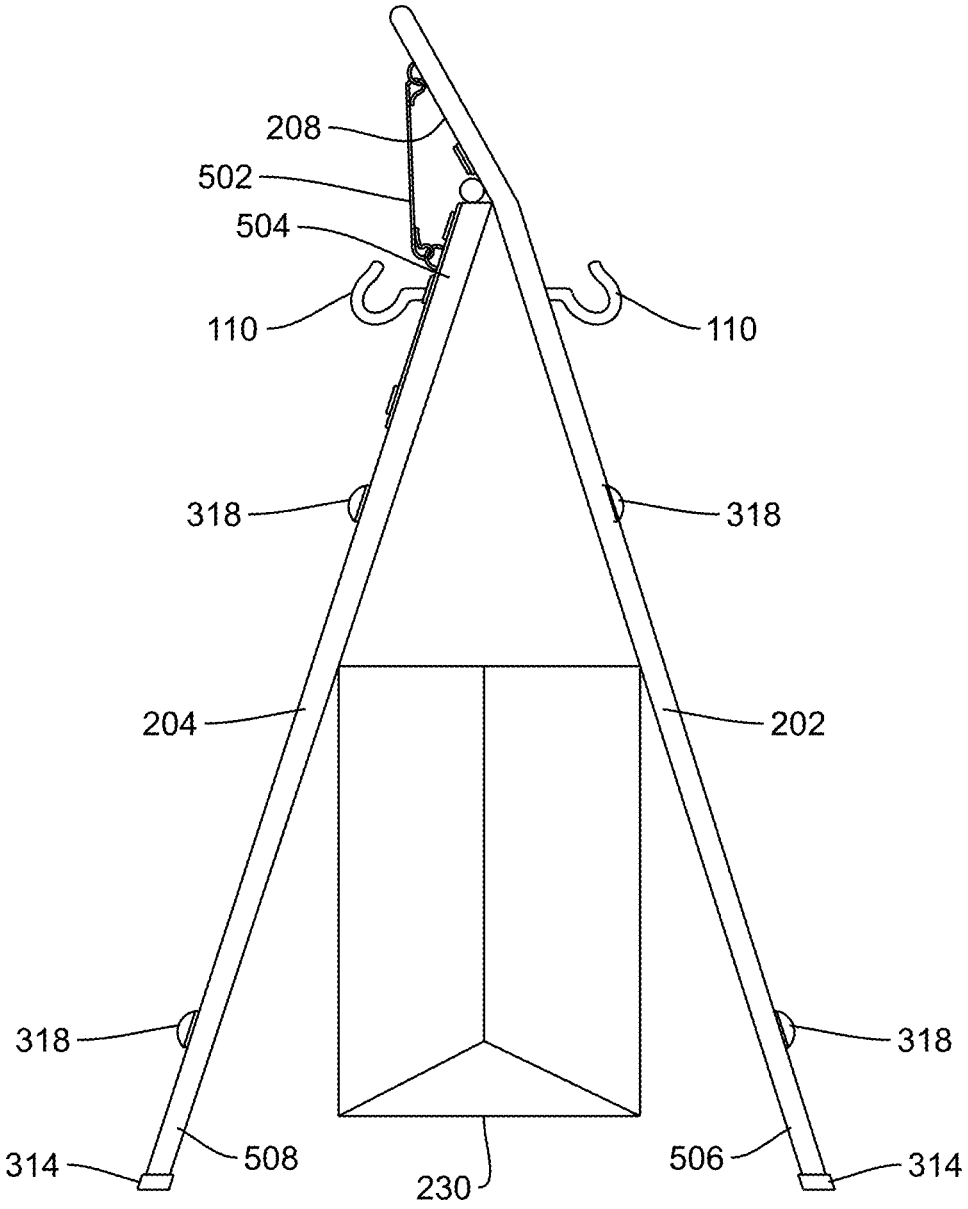
FIG. 5B is a side view of a grocery bag holder with a releasably engageable catch for keeping the grocery bag holder with an angled handle region and in an open conformation, according to an illustrative embodiment.

FIG. 5B is a side view of a grocery bag holder with a releasably engageable catch for keeping the grocery bag holder with an angled handle region and in an open conformation, according to an illustrative embodiment. In various embodiments, the upper handle region 208 can be angled towards the second support, which can bring the upper handle region 208 closer to the upper portion 504 of the second support 204 when the grocery bag holder is in an open conformation. Decreasing the angle between the upper handle region 208 and the second support 204 can increase the strength with which the releasably engageable catch can maintain the grocery bag holder in an open conformation.

The releasably engageable catch can maintain the first support and the second support at an angle that is within 5 degrees of the maximum angle maintained by the pivot limiter. The releasably engageable catch can maintain the first support and the second support at an angle that is within 10 degrees of the maximum angle maintained by the pivot limiter.

Turning to FIGS. 5A and 5B, releasably engageable catch 502 can be a hook that can be attached to one support at a proximal end, and can hook into a loop at the distal end. Releasably engageable catch 502 can be a strap that can be attached to one support and can clip into a connection on the other support. Releasably engageable catch 502 can use hook-and-loop tape to connect between the upper handle region 208 and the upper portion 504 of the second support 204. Releasably engageable catch 502 can be any of a variety of mechanical fasteners that can prevent the grocery bag holder from transitioning from an open conformation to a closed conformation.

Figure 6:
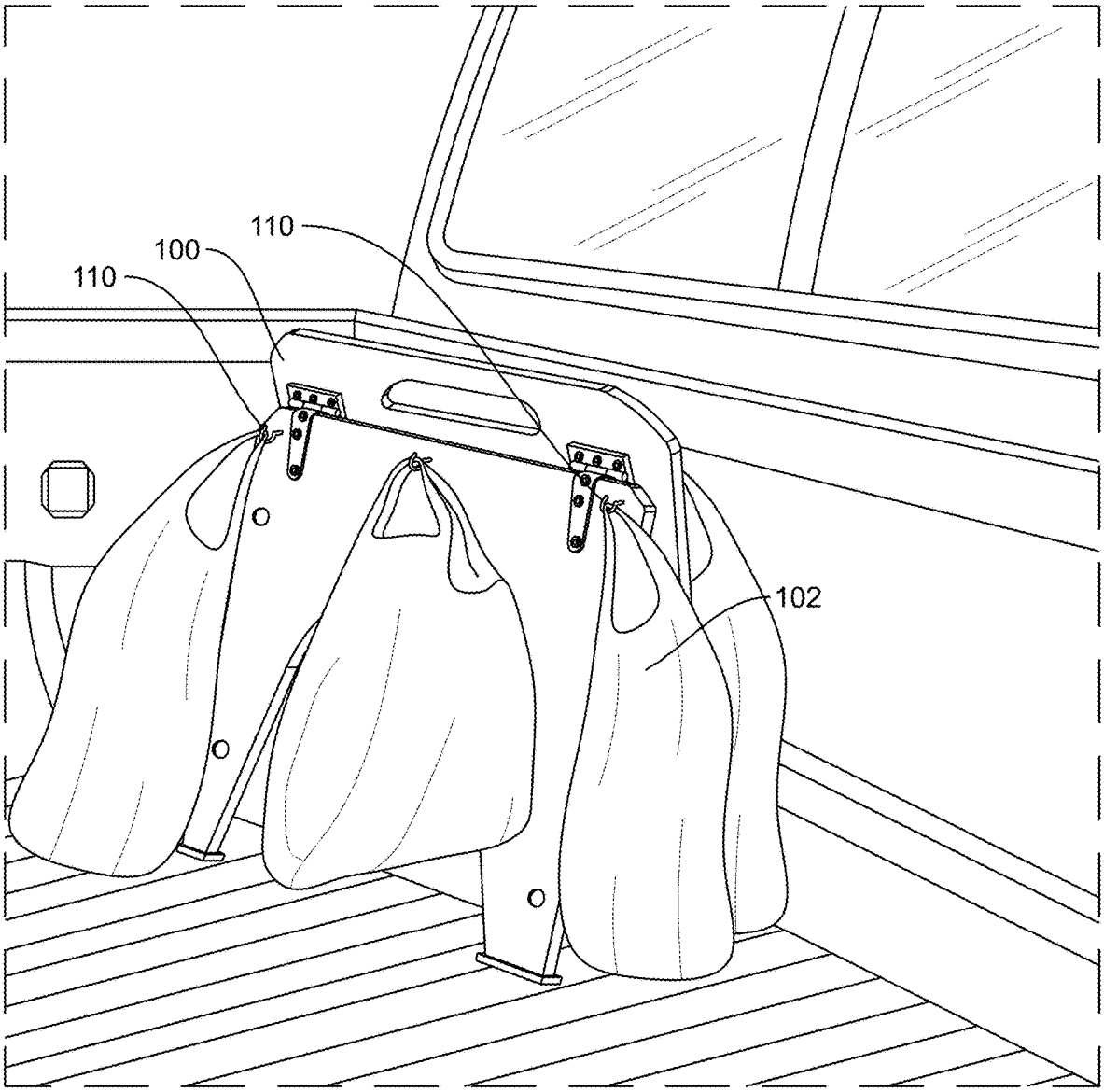
FIG. 6 is a perspective view of a grocery bag holder maintaining grocery bags in an upright arrangement in the back of a truck, according to an illustrative embodiment.

FIG. 6 is a perspective view of a grocery bag holder maintaining grocery bags in an upright arrangement in the back of a truck, according to an illustrative embodiment. A user can open the grocery bag holder 100 into an open conformation in a trunk, back of a car, truck bed, or other locations for transporting groceries. With the grocery bag holder in an open conformation, the user can hang the handles of grocery bags 102 on the hooks 110. In this way, the mouths of the grocery bags are held upwards, so that the content of the grocery bags do not spill out of the bag 102. The user can now drive the vehicle home knowing that the contents of the grocery bags will not spill.

Both the first support 202 and the second support 204 can have a plurality of hooks 110, so that in the open conformation, grocery bags can hang from both the first and second supports 202, 204. Hooks 110 can be positioned in various locations from side to side and on both supports, so that the weight of the grocery bags can be evenly distributed.

Figure 7:
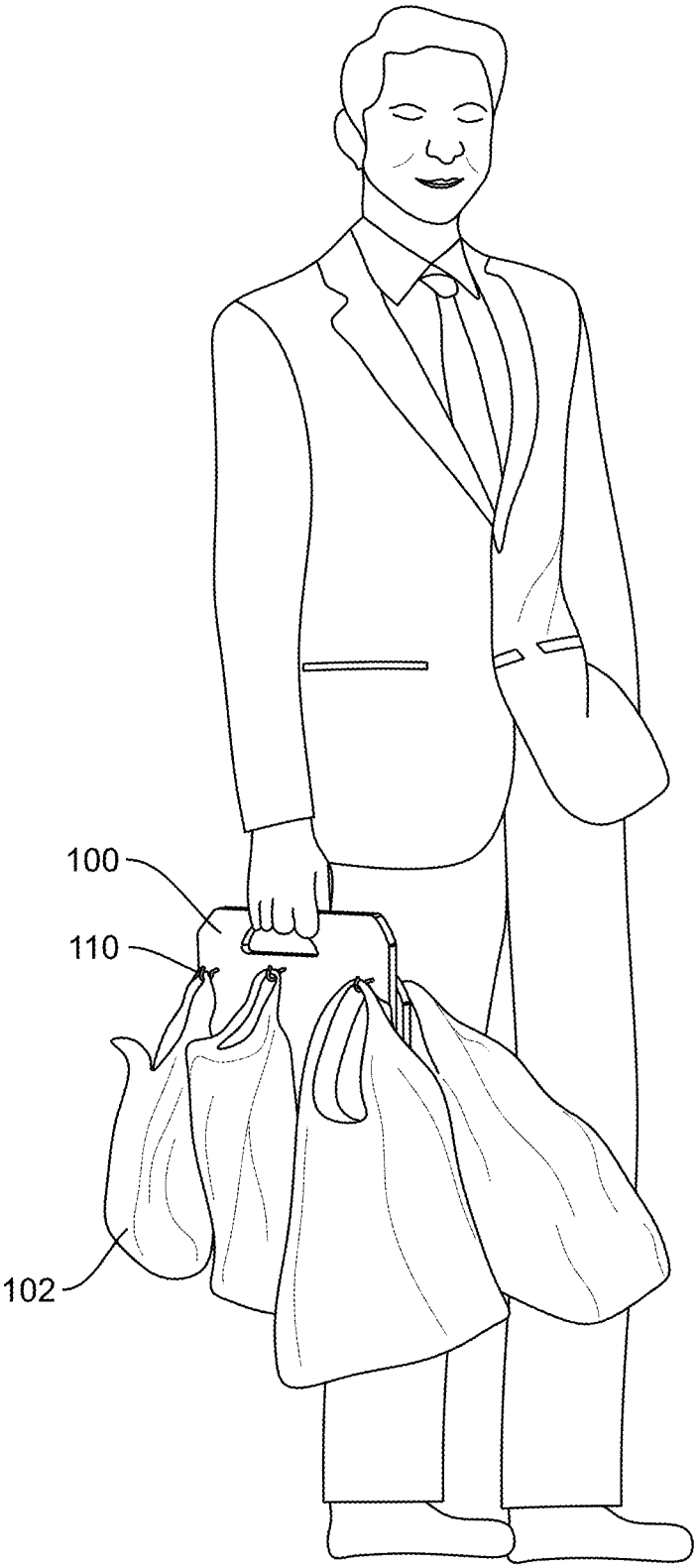
FIG. 7 is a perspective view of a user using the grocery bag holder to carry a large number of grocery bags at the same time, according to an illustrative embodiment.

FIG. 7 is a perspective view of a user using the grocery bag holder to carry a large number of grocery bags at the same time, according to an illustrative embodiment. The user can arrive home with the groceries still held within the grocery bags, and the grocery bags still held on the hooks 110. The user can pick up the grocery bag holder quickly and easily with one hand, and can carry the grocery bag holder into the house with all of the grocery bags still hanging from the hooks 110. Unlike having heavy bags with thin plastic handles cutting into the user's hands, the handle of the grocery bag holder allows the user to carry all of the grocery bags comfortably, despite the weight of many bags carried at the same time. A user can optionally use the LEDs to light up the path between the user's vehicle and the user's front door to increase safety and convenience as the user carries the groceries in from the car.

In embodiments with a support strap or a releasably engageable catch, the user can optionally release the support strap or releasably engageable catch, thereby allowing the grocery bag holder to transition to a closed conformation. The closed conformation can reduce the size or width of the combined grocery bag holder and grocery bags, thereby making the entire load easier to carry while walking. The user can later open the grocery bag holder to the open conformation and set the grocery bag holder on a kitchen counter, table, etc. The grocery bag holder can maintain the grocery bags in an upright position as the user unloads groceries into the appropriate food storage areas. In various embodiments, the user can store the empty grocery bags within the inner storage pocket and can place the entire system back in the vehicle so that the grocery bags and grocery bag holder are ready for the next trip to the grocery store.

Although this invention has been disclosed in the context of certain embodiments and examples, it will be understood by those skilled in the art that the present invention extends beyond the specifically disclosed embodiments and/or uses of the invention and obvious modifications and equivalents thereof. Thus, it is intended that the scope of the present invention herein disclosed should not be limited by the particular disclosed embodiments described above.

References to "one embodiment", "an embodiment", "another embodiment", "one example", "an example", "another example" and so on, indicate that the embodiment (s) or example(s) so described may include a particular feature, structure, characteristic, property, element, or limitation, but that not every embodiment or example necessarily includes that particular feature, structure, characteristic, property, element or limitation.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Also, as used herein, various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances (e.g. 5%) of the system. Accordingly, this description is meant to be taken only by way of example, and not to otherwise limit the scope of this invention.

What is claimed is:

1. A grocery bag holder comprising:

a first support, the first support comprising:
- a upper handle region, the upper handle region further comprising a handle;
- a first lower portion, the first lower portion further comprising a first base area; and
- a hinge region between the upper handle region and the first lower portion, wherein the upper handle region extends up above the hinge region, the hinge region further comprising at least one hinge;

a second support, the second support comprising:
- a second lower portion, the second lower portion further comprising a second base area;
- an upper hinge region, the upper hinge region hingedly connected to the hinge region of the first support by the at least one hinge; and a plurality of bag suspenders adapted to hold grocery bag handles.

2. The grocery bag holder of claim 1, further comprising a support strap connected to the first support and the second support, the support strap preventing the first lower portion from pivoting away from the second lower portion beyond a predetermined maximum angle.

3. The grocery bag holder of claim 1, further comprising a selectively engageable prop adapted to engage between the first lower portion and the second lower portion, the selectively engageable prop selectively preventing the first lower portion and the second lower portion from pivoting towards each other beyond a predetermined angle.

4. The grocery bag holder of claim 1, further comprising a storage pocket, the storage pocket connected to the first support and the second support, the storage pocket acting as a pivot limiter to limit the maximum angle of the first lower portion relative to the second lower portion.

5. The grocery bag holder of claim 1, further comprising a selectively engageable catch adapted to engage between the second support and the upper handle region of the first support, the selectively engageable catch selectively preventing the second support and the upper handle region of the first support from pivoting away from each other beyond a predetermined angle.

6. The grocery bag holder of claim 5, wherein the upper handle region of the first support is bent at an angle relative to the first lower portion, so that the upper handle region leans downwards and towards the second support.

7. The grocery bag holder of claim 1, further comprising a plurality of LED lights located on the first support and/or second support.

8. The grocery bag holder of claim 7, further circuitry that enables the LEDs to flash in a manner adapted to warn drivers of possible danger.

9. The grocery bag holder of claim 1, wherein the first base area and the second base area further comprise non-skid feet adapted to prevent the grocery bag holder from slipping in a moving vehicle.

10. A method of transporting groceries, the method comprising:

transitioning a grocery bag holder to an open conformation, the grocery bag holder comprising:
- a first support, the first support comprising:
  - a upper handle region, the upper handle region further comprising a handle;
  - a first lower portion, the first lower portion further comprising a first base area; and
  - a hinge region between the upper handle region and the first lower portion, wherein the upper handle region extends up above the hinge region, the hinge region further comprising at least one hinge;
- a second support, the second support comprising:
  - a second lower portion, the second lower portion further comprising a second base area;
  - an upper hinge region, the upper hinge region hingedly connected to the hinge region of the first support by the at least one hinge; and
- a plurality of bag suspenders adapted to hold grocery bag handles;

setting the grocery bag holder in the open conformation within a storage space of a vehicle;

hanging the handles of grocery bags on the plurality of bag suspenders; and driving the vehicle with the groceries remaining within the grocery bags.

11. The method of claim 10, further comprising after driving the vehicle home with the groceries remaining within the grocery bags, lifting the grocery bag holder out of the vehicle with grocery bags hanging from the bag suspenders, and carrying the grocery bag holder into a residence.

12. The method of claim 11, further comprising setting the grocery bag holder on a counter or table in a residence with the grocery bags hanging from the bag suspenders and the groceries within the grocery bags, and emptying the groceries out of the grocery bags and into the appropriate food storage areas within the home.

13. The method of claim 10, further comprising engaging a selectively engageable catch between the second support and the upper handle region of the first support, the selectively engageable catch preventing the second support and the upper handle region of the first support from pivoting away from each other beyond a predetermined angle.

14. The method of claim 13, further comprising after driving the vehicle home with the groceries remaining within the grocery bags, disengaging the selectively engageably catch between the second support and the upper handle region, thereby allowing the grocery bag holder to transition to a closed conformation, and lifting the grocery bag holder out of the vehicle with grocery bags hanging from the bag suspenders, and carrying the grocery bag holder into a residence.

15. The method of claim 10, further comprising engaging a selectively engageable prop between the first lower portion and the second lower portion, the selectively engageable prop selectively preventing the first lower portion and the second lower portion from pivoting towards each other beyond a predetermined angle.

16. The method of claim 15, further comprising after driving the vehicle home with the groceries remaining within the grocery bags, disengaging the selectively engageable prop between the second support and the upper handle region, thereby allowing the grocery bag holder to transition to a closed conformation, and lifting the grocery bag holder out of the vehicle with grocery bags hanging from the bag suspenders, and carrying the grocery bag holder into a residence.

* * * * *